US008378808B1

(12) United States Patent
Gwaltney

(10) Patent No.: US 8,378,808 B1
(45) Date of Patent: Feb. 19, 2013

(54) DUAL INTERCOM-INTERFACED SMOKE/FIRE DETECTION SYSTEM AND ASSOCIATED METHOD

(76) Inventor: Torrain Gwaltney, Hughesville, MD (US)

( * ) Notice: Subject to any disclaimer, the term of this patent is extended or adjusted under 35 U.S.C. 154(b) by 0 days.

(21) Appl. No.: 13/475,119

(22) Filed: May 18, 2012

Related U.S. Application Data

(63) Continuation-in-part of application No. 11/784,378, filed on Apr. 6, 2007, now abandoned.

(51) Int. Cl.
*G08B 19/00* (2006.01)

(52) U.S. Cl. ... 340/506; 340/519; 340/531; 340/539.25; 340/539.26; 340/286.05; 340/286.06; 340/691.1; 340/691.3

(58) Field of Classification Search ..... 340/500–501, 340/517, 520–524, 519, 531, 539.25, 539.26, 340/286.05, 286.06, 691.1, 691.3; 379/37–50
See application file for complete search history.

(56) References Cited

U.S. PATENT DOCUMENTS

| | | | | |
|---|---|---|---|---|
| 2,715,720 | A | 8/1955 | Jenkins | 250/564 |
| 3,961,320 | A | 6/1976 | Erdmann et al. | 340/517 |
| 4,117,479 | A | 9/1978 | Galvin et al. | 340/502 |
| 4,141,006 | A | 2/1979 | Braxton | 379/40 |
| 4,375,637 | A | 3/1983 | Desjardins | 340/517 |
| 5,598,456 | A | 1/1997 | Feinberg | |
| 5,654,690 | A | 8/1997 | Ishikawa et al. | 340/506 |
| 5,751,209 | A | 5/1998 | Werner et al. | 340/286.05 |
| 5,910,765 | A | 6/1999 | Slemon et al. | 340/517 |
| 6,097,288 | A | 8/2000 | Koeppe, Jr. | |
| 6,097,289 | A | 8/2000 | Li et al. | 340/531 |
| 6,150,935 | A | 11/2000 | Anderson | |
| 6,249,221 | B1 | 6/2001 | Reed | 340/539.14 |
| 6,317,042 | B1 | 11/2001 | Engelhorn et al. | 340/539.16 |
| 6,525,658 | B2 | 2/2003 | Streetman et al. | 340/522 |
| 6,563,910 | B2 * | 5/2003 | Menard et al. | 379/45 |
| 6,624,750 | B1 | 9/2003 | Marman et al. | 340/506 |
| 6,778,071 | B2 | 8/2004 | Megerle | 340/332 |
| 6,930,596 | B2 | 8/2005 | Kulesz et al. | 340/506 |
| 6,972,676 | B1 | 12/2005 | Kimmel et al. | 340/506 |
| 6,975,220 | B1 | 12/2005 | Foodman et al. | 340/531 |
| 7,034,701 | B1 | 4/2006 | Rose-Pehrsson et al. | 340/628 |
| 7,079,020 | B2 | 7/2006 | Stilp | 340/506 |
| 7,123,142 | B2 | 10/2006 | Bohbot et al. | 340/539.14 |
| 7,148,810 | B2 | 12/2006 | Bhat | 340/692 |
| 7,158,026 | B2 * | 1/2007 | Feldkamp et al. | 340/531 |
| 7,170,418 | B2 | 1/2007 | Rose-Pehrsson et al. | 340/628 |
| 7,218,238 | B2 | 5/2007 | Right et al. | 340/628 |
| 7,221,260 | B2 | 5/2007 | Berezowski et al. | 340/286.05 |
| 7,253,732 | B2 * | 8/2007 | Osann, Jr. | 340/541 |
| 7,378,942 | B2 | 5/2008 | Seeley et al. | 340/286.01 |
| 7,835,516 | B2 * | 11/2010 | Wong | 379/398 |
| 2004/0086093 | A1 * | 5/2004 | Schranz | 379/37 |
| 2005/0184867 | A1 * | 8/2005 | Osann, Jr. | 340/539.25 |
| 2005/0273831 | A1 * | 12/2005 | Slomovich et al. | 725/105 |

* cited by examiner

*Primary Examiner* — Daniel Wu
*Assistant Examiner* — Son M Tang

(57) ABSTRACT

A dual intercom-camera-interfaced smoke/fire detection system and method includes, inter alia, an interactive panoramic camera communication system operatively responsive to real-time emergency signals. The interactive camera service provider communications network independently and communicatively couples panoramic cameras in real-time to authorized peripheral electronic devices (APEDs) such that an emergency event is independently transmitted and directly viewed in real-time at the APEDs. The interactive camera service provider communications network is independently operable from a real-time emergency signal transmitting mechanism and a real-time emergency signal simultaneous transmitting mechanism, respectively. The emergency event is independently viewed at the APEDs while real-time emergency signals are transmitted to a central monitoring station such that the APEDs independently and visually learn the emergency event at least as early as the central monitoring station non-visually learns the emergency event.

18 Claims, 5 Drawing Sheets

DUAL INTERCOM-INTERFACED SMOKE/FIRE DETECTION SYSTEM AND ASSOCIATED METHOD

CROSS REFERENCE TO RELATED APPLICATIONS

This application is a continuation-in-part application of U.S. patent application Ser. No. 11/784,378, filed Apr. 6, 2007, currently pending, which claims the benefit of U.S. Provisional Application No. 60/789,941, filed Apr. 7, 2006, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to alarm systems and, more particularly, to a dual intercom-camera-interfaced smoke/fire detection system and associated method for notifying multiple persons of an emergency event.

2. Prior Art

Various systems are known for the detection of alarm conditions. One particular form of such a system is a smoke or fire detecting system. Upon receipt of inputs from one or more of the detectors of the system, a control unit associated with the system is able to make a determination as to whether or not a fire condition is present in one or more regions of interest. A variety of techniques have been used in the past for the purpose of making this determination. Sensors of smoke such as photoelectric smoke detectors or ionization-type smoke detectors are intended to provide outputs indicative of sensed levels of ambient smoke. Environmental noise, such as dust particles or insects which may enter the respective detector can produce variations in output signals from the sensors which are not in any way correlated with the presence of smoke. These noise outputs can produce false alarms if the sensitivity of the respective detector is high enough. Such false alarms are undesirable. Based on the above mentioned history, it would be advantageous to provide an alarm system and method that detected both smoke and fire while minimizing false alarms with the ability to communicate the alarm through an existing intercom system.

This prior art example shows an alarm system which incorporates a plurality of highly sensitive, early warning, smoke detectors for distinguishing between detector signals in response to ambient smoke and detector signals in response to the presence of non-smoke materials. Such detectors are spatially arranged in predetermined regions. Information concerning the arrangement of the detectors is stored in the common control unit. Additionally, a performance history for each of the detectors is also stored in the control unit.

If one of the detectors exhibits a relatively large output which is large enough to indicate a possible fire, a previously stored history from the outputs of that detector is analyzed. If the previously stored history indicates a fire related profile, such as a relatively gradual increase in smoke level over a period of time, the signal from that detector is regarded as being indicative of smoke and an alarm is indicated. If the signal from the detector shows a relatively fast increase, from a very low level to an alarm level in a short period of time, fibrous material may have entered the detector. The output from at least one other detector in the same region is analyzed. If the second detector confirms the presence of smoke, the first detector is regarded as indicating an alarm condition. If the second detector does not indicate the presence of smoke, even a very low level of smoke, the output from the first detector is regarded as being due to a non-smoke condition, such as an intrusive fibrous material. Unfortunately, this prior art example does not communicate the alarm signal throughout an intercom system.

Another prior art example shows an expandable and modular intercom and annunciation system that includes a plurality of signal sources such as smoke detectors, breakage detectors, intrusion detectors, telecommunication detectors (such as ringers), and gas detectors.

The intercom unit has a processor, a memory, and a user interface including an audio output. The processor of the intercom unit is programmed with instructions to determine relative priorities among the plurality of common communication protocol signals, to select a first common communication protocol signal having a highest relative priority during a selected time interval, to announce a message corresponding to the first common communication protocol signal during the selected time interval, and to maintain a quiet interval for an announcement entered by an individual via the user interface. Unfortunately, this prior art example is not designed to communicate the alarm signals through an intercom system.

Another prior art example shows an integrated telephone, intercom, security and control system for a building having a plurality of units that utilizes a plurality of telephone lines located throughout the building which are connected at one end to telecommunications equipment located in the units and throughout common areas of the building. A digital switching device is connected to the other end each of the telephone lines and arranged to connect at least one of the telephone lines to at least one of another of the telephone lines or to an outside telephone line at the option of a user of the telecommunications equipment. A plurality of sensors located in the units and throughout common areas of the building is arranged for generating signals in response to conditions therein, which are then transmitted to a plurality of control modules connected to the digital switching device by at least one of the telephone lines. The control modules are further adapted to send information to a central monitoring station via the telephone lines indicative of the respective conditions and the central monitoring station is adapted to at least receive and store this information in its memory and output data indicative of the respective conditions. Unfortunately, this prior art example requires the use of telephone lines connected throughout the building.

BRIEF SUMMARY OF THE INVENTION

In view of the foregoing background, it is therefore an object of the present invention to provide a system and method for notifying multiple persons of an emergency event. These and other objects, features, and advantages of the invention are provided by an dual intercom-camera-interfaced smoke/fire detection system and associated method.

The system includes a plurality of sensors for conveniently detecting an emergency event within a building structure. Such sensors are effectively positioned in unique portions of the building structure and transmit real-time emergency signals that correspond to a detected type of the emergency event. The system further includes a plurality of remotely located intercom panels positioned in alternate areas of the building structure that are in communication with the sensors and a remotely located central monitoring station in communication with such intercom panels. A sub speaker may also be employed for emitting a low frequency vibration as an additional level of warning for the visually impaired customer/blind person.

The intercom routing interface includes a logic gate for advantageously receiving the control signals. Such a logic gate conveniently generates a true output signal if both of the first and second control signals are true. A plurality of switches is connected in parallel with each of the intercom panels and the logic gate. Such switches are simultaneously closed upon receiving the true output signal from the logic gate such that the intercom routing interface effectively transmits the indefinable data segments to each of the intercom panels to thereby allow each of the intercom panels to advantageously receive real-time and continuous information regarding the status of the emergency event.

The device further includes a central controller mounted on an interior of a building structure. Such a central controller conveniently includes a mechanism for transmitting the real-time emergency signals to each of the intercom panels during the emergency event. The real-time emergency signal transmitting mechanism effectively includes: a processor housed within the central controller, an intercom routing interface electrically coupled to the processor and positioned exterior of the central controller, a memory electrically coupled to the processor and including software instructions that cause the central controller to transmit the real-time emergency signals directly to the intercom panels.

Such software instructions advantageously include and execute a programmable control logic algorithm which determine an originating location of the real-time emergency signals, determine a type of the emergency event by extracting selected data streams from the real-time emergency signals and parsing the data streams into identifiable data segments, and, if the identifiable data segments have originated from a unique location and indicate a unique type of emergency event, then conveniently generate first and second true control signals. If either one of the identifiable data segments did not originate from a unique location or did not indicate a unique type of emergency event, than effectively generates at least one false control signal.

The system further includes a mechanism for simultaneously transmitting the real-time emergency signals to the central monitoring station to thereby allow the central monitoring station to advantageously verify the emergency event directly with the intercom panels and a user interface electrically mated directly to the processor. Such a user interface conveniently transmits a command signal to the processor based upon a user input.

The system further includes a real-time emergency signal transmitting mechanism that effectively includes a plurality of communication interface modules electrically mated directly to the processor. Each of the communication interface modules advantageously receives the real-time emergency signals and a first communications link is established between the communication interface modules and the central monitoring station for transmitting the real-time emergency signals to the central monitoring such that the central monitoring station receives continuous information regarding the emergency event. A second communications link is conveniently established between the intercom routing interface and the central monitoring station such that the central-monitoring station maintains direct communication with each of the intercom panels during the emergency event. The system further includes a transducer electrically mated directly to the processor for effectively transmitting at least one of an audible and visual signal based upon the type of the detected emergency event.

A method for transmitting real-time emergency signals to multiple intercom panels located within a building structure includes the steps of providing a plurality of sensors for detecting the emergency event within a building structure. Such sensors are positioned in unique portions of the building structure and transmit real-time emergency signals that correspond to a detected type of the emergency event.

The steps further include providing a plurality of remotely located intercom panels positioned in alternate areas of the building structure and are in communication with the sensors. The steps further include providing a remotely located central monitoring station in communication with the intercom panels, providing a central controller mounted on an interior of a building structure, transmitting the real-time emergency signals to each of the intercom panels during the emergency event, and simultaneously transmitting the real-time emergency signals to the central monitoring station to thereby allow the central monitoring station to verify the emergency event directly with the intercom panels.

The steps further include providing a processor housed within the central controller; electrically coupling an intercom routing interface to the processor; electrically coupling a memory to the processor and including software instructions that cause the central controller to transmit the real-time emergency signals directly to the intercom panels. Such software, instructions including and executing a programmable control logic algorithm, include the steps of determining an originating location of the real-time emergency signals, determining a type of the emergency event by extracting selected data streams from the real-time emergency signals and parsing the data streams into identifiable data segments, and if the identifiable data segments have originated from a unique location and indicate a unique type of emergency event, then generating first and second true control signals. If either one of the identifiable data segments has not originated from a unique location or does not indicate a unique type of emergency event, then the steps include generating at least one false control signal.

The steps further include providing a logic gate for receiving the control signals. Such a logic gate generates a true output signal if both of the first and second control signals are true. The steps further include connecting a plurality of switches in parallel with each of the intercom panels and the logic gate and simultaneously closing each of the switches upon receiving the true output signal from the logic gate such that the intercom routing interface transmits the indefinable data segments to each of the intercom panels to thereby allow each of the intercom panels to receive real-time and continuous information regarding the status of the emergency event.

The steps further include providing a plurality of communication interface modules electrically mated directly to the processor. Each of the communication interface modules receives the real-time emergency signals. The steps further include establishing a first communications link between the communication interface modules and the central monitoring station for transmitting the real-time emergency signals to the central monitoring such that the central monitoring station receives continuous information regarding the emergency event and establishing a second communications link between the intercom routing interface and the central monitoring station such that the central-monitoring station maintains direct communication with each of the intercom panels during the emergency event.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
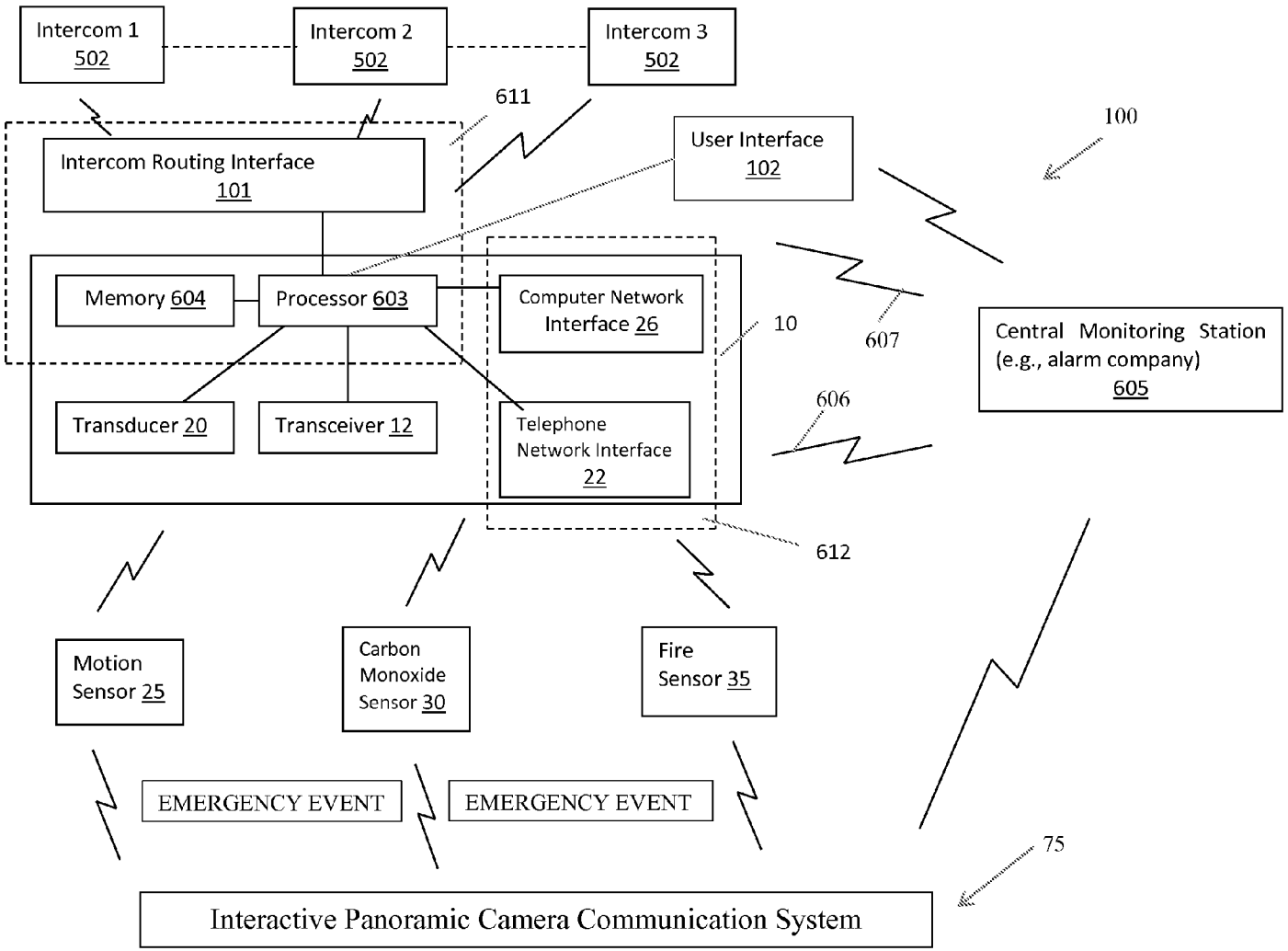
FIG. 1 is a schematic block diagram showing the interrelationship of selected major components of an dual intercom-camera-interfaced smoke/fire alarm system, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The system of this invention is referred to generally in FIGS. 1-4 by the reference numeral 10 and is intended to protect a dual intercom-camera-interfaced smoke/fire detection system. It should be understood that the apparatus 10 may be used to protect many different types of buildings and should not be limited in use to protecting only those types of buildings described herein.

A non-limiting exemplary embodiment of system 100 is shown as including panoramic cameras 70 that can be panned to view all areas in a room or particular office space (e.g., building structure). This system 100 can be used in a corporate setting or in home use. When an alarm event (e.g., emergency event) is detected, a verbal message is transmitted to occupants within the building structure and/or a text message is transmitted to an authorized peripheral electronic device (APED) outside of the building structure—such as a homeowner's cellular telephone—stating the emergency event has been detected.

For example, when the emergency event is detected in a bed room or office, the system 100 will allow the owners to view each room in the occupied space or house through cellular transmission using a smartphone touch screen security application (Smart App) to connect to the security system 100 via an interactive panoramic camera communication system 75. The Smart App can be loaded onto any smart phone device such as IPOD TOUCH®, IPHONE®, IPAD®, or BLACK BERRY® smart phone devices, etc. This allows an authorized user to control operation of panoramic cameras 70 and thereby scroll from room-to-room or space-to-space using a user interface (e.g., tracking ball, touch screen, etc.).

In a non-limiting exemplary embodiment, a interactive panoramic camera communication network 71 is assigned a unique Internet Protocol "IP" address and thereby simultaneously communicates the emergency event with local authorities, for example. In a case of a home burglary and/or unauthorized invasion, when the emergency event is detected, an alarm is activated and a real-time signal (e.g., video signal, text message, etc.) is immediately transmitted to the authorities. With this real-time signal there is no delay that is often caused by after-the-fact and/or request-for-response times. The real-time signal directly contacts the authorities (via the APEDs 72) for immediate response and/or simultaneously notifies a central monitoring station 60 (e.g., alarm company). The authorities can now have an immediate visual IP connection to the emergency event via panoramic cameras 70, for example.

As previously mentioned, a home owner now has a visual presence to the building structure while the owner is out of town (e.g., vacation, business, holiday, etc.). Conventional alarm systems require home owners to register their alarm system through the local law enforcement and/or government authorities using an alarm registration number. The present system 100 embeds such an alarm registration number with the assigned IP address and thereby automatically transmits the alarm registration number to the authorities and/or service provider via the internet connection and URL protocol.

Transmission of such information via an IP will visually allow the authorities to visually inspect and locate the emergency event before emergency vehicles and/or local authorities arrive at the building structure. This automated process provides pin-point location of the emergency event (e.g., live fire, home invasion, etc.) through smart phone streaming media. Providing a real-time visual depiction of the emergency event limits the number of false alarms and cost for emergency personnel to arrive at false emergency events.

In a non-limiting exemplary embodiment, controller 10 may be directly wired and/or otherwise communicatively coupled to a legacy conventional camera home security system (e.g., interactive panoramic camera communication system 75) providing consumers with an option of eliminating a third party service provider such as an alarm company and/or other third party vendor that notifies local authorities of the emergency event. Of course, the APEDs 72 enable an authorized user to view each room and/or office space on a conventional home television and/or monitored through an available television channel.

Advantageously, as explained hereinbelow, the present alarm system 100 provides direct, real-time and private communication between the home owner and local authorities such as a communicating a password override code to the local authorities and/or providing camera override control to the local authorities. Of course, users of the present alarm system 100 may enjoy a discount on their homeowner insurance policy.

Figure 2:
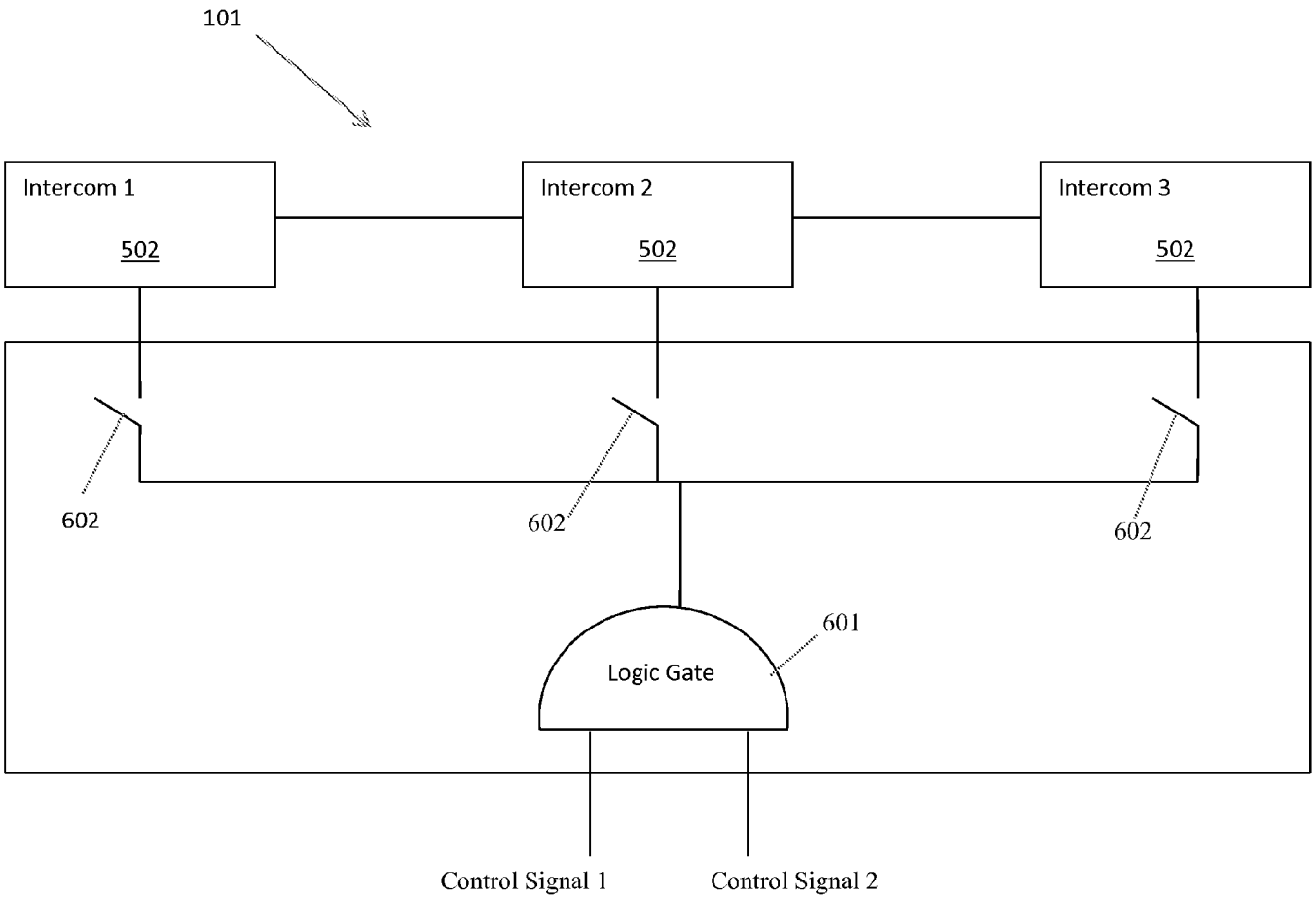
FIG. 2 is a schematic block diagram of the intercom routing interface.
Figure 3:
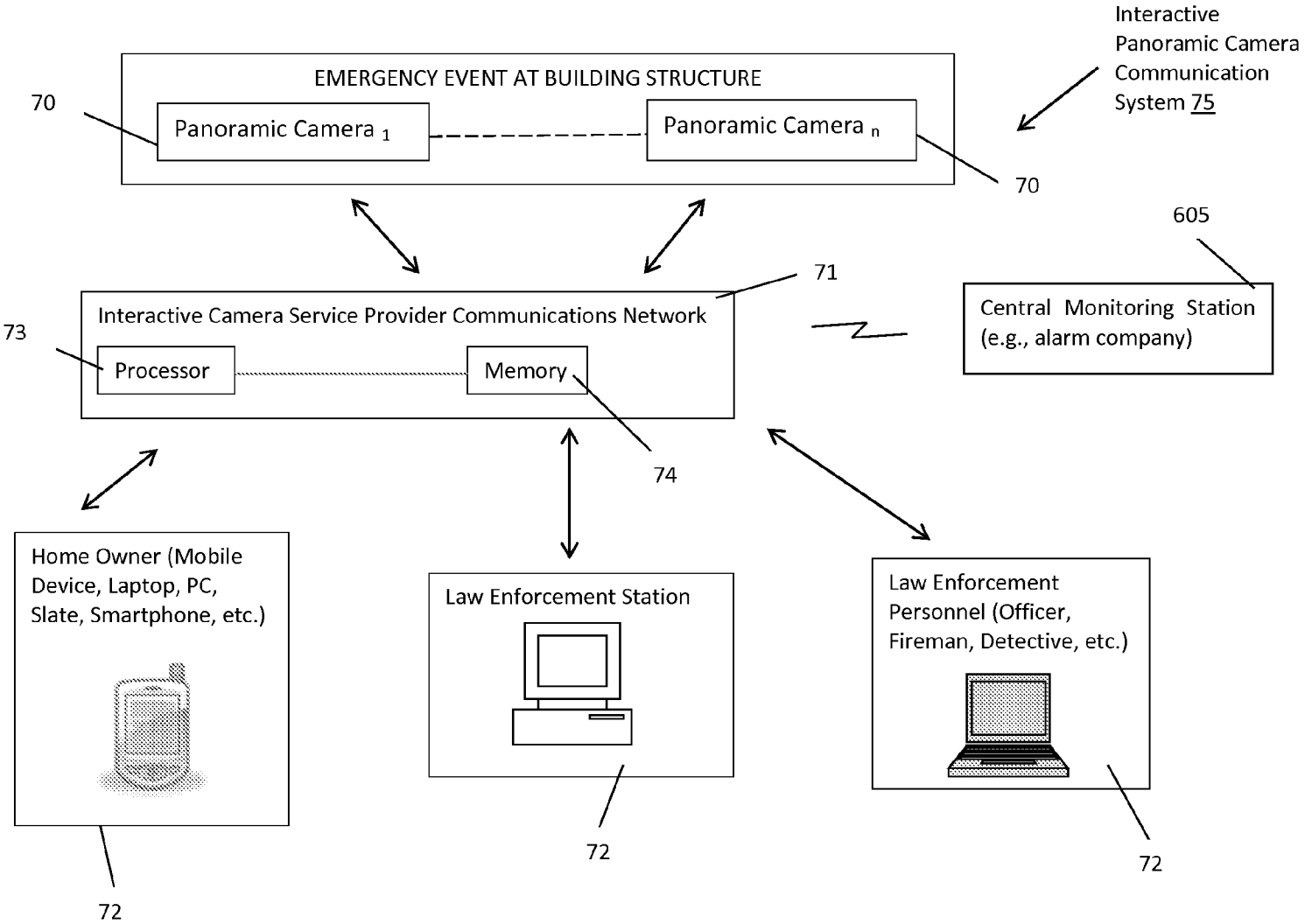
FIG. 3 is a schematic block diagram showing the interrelationship of selected major components of an dual intercom-camera-interfaced smoke/fire alarm system, in accordance with the present invention.
Figure 4:
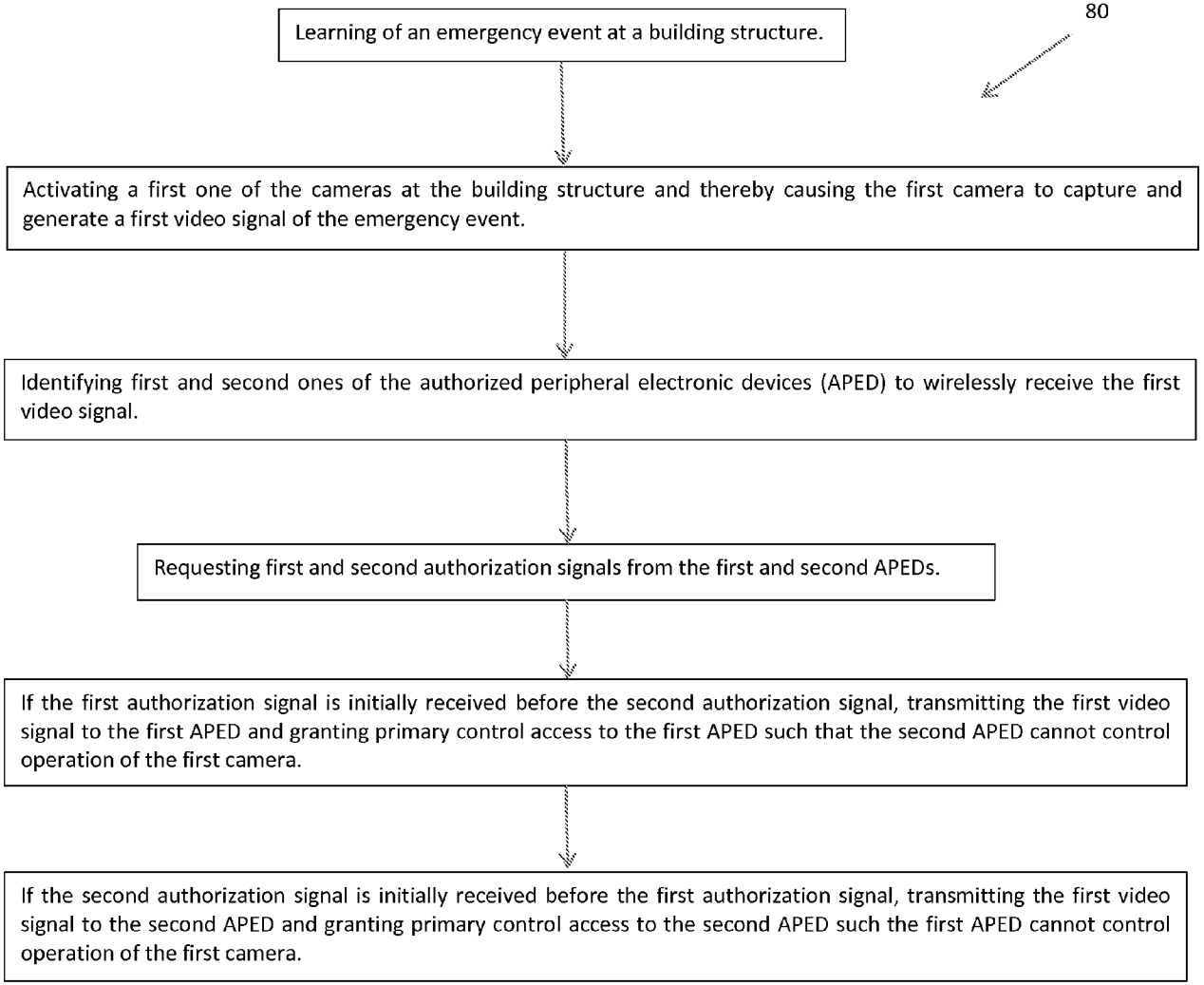
FIG. 4 is a flow chart of the control logic algorithm executed by the interactive panoramic camera communication system for granting access to video signals based on a learned hierarchical level of authorized peripheral electronic devices (APED).
Figure 4:
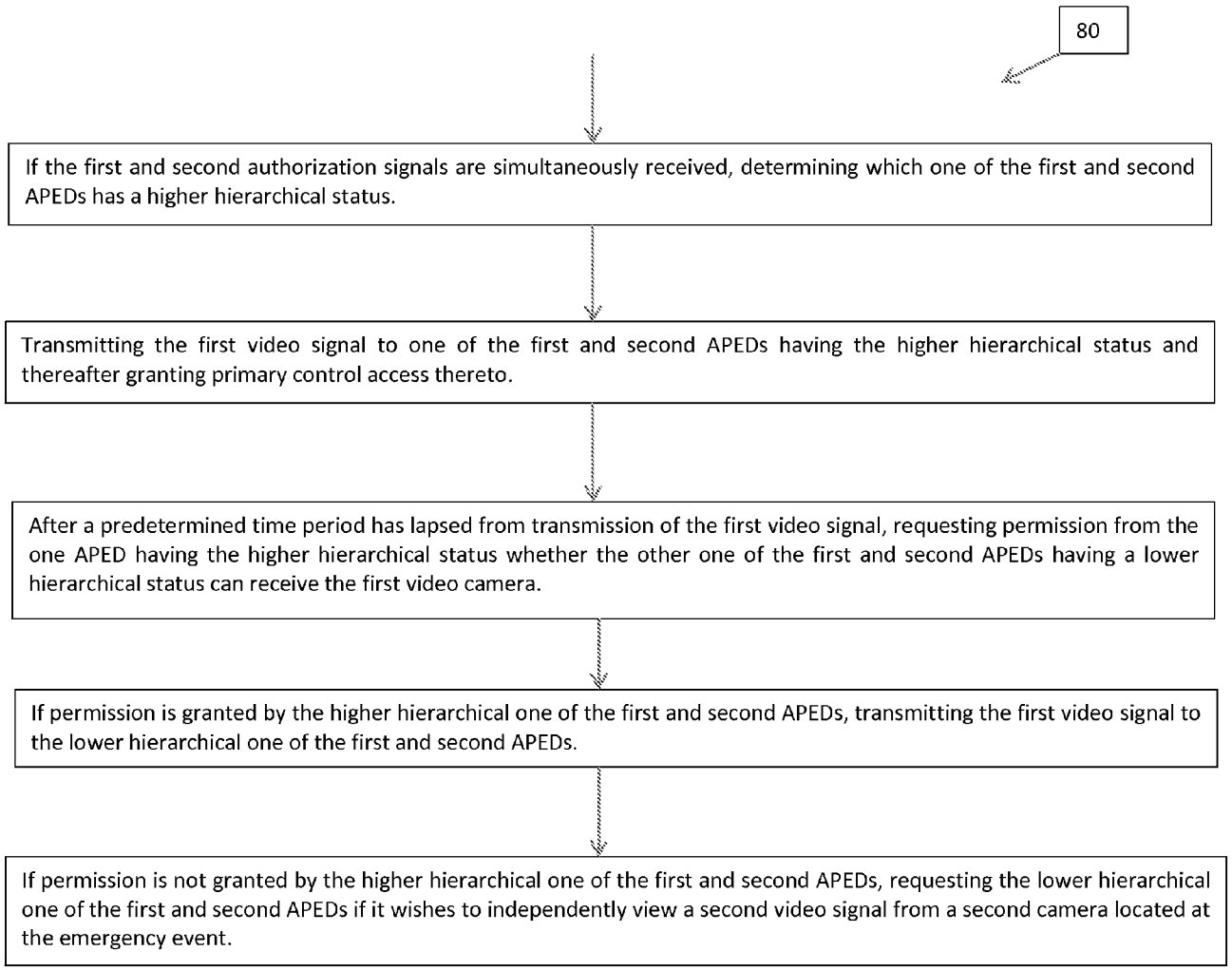

Referring to FIGS. 1 and 2, the system includes a plurality of sensors 25, 30 and 35 which is essential for detecting an emergency event within a building structure. Such sensors 25, 30 and 35 are critically positioned in unique portions of the building structure and transmit real-time emergency signals that correspond to a detected type of the emergency event. The system further includes a plurality of remotely located intercom panels 502 positioned in alternate areas of the building structure that are in communication with the sensors 25, 30 and 35 and a remotely located central monitoring station 605 in communication with such intercom panels 502. Such positioning of the intercom panels 502 allows the sensors 25, 30 and 35 to detect and communicate real-time emergency events in all areas of the building.

Referring to FIG. 2, the intercom routing interface 101 includes a logic gate 601 which is crucial for receiving the control signals. Such a logic gate 601 generates a true output signal if both of the first and second control signals are true. A plurality of switches 602 is connected in parallel with each of the intercom panels 502 and the logic gate 601. Such switches 602 are simultaneously closed upon receiving the true output signal from the logic gate 601 such that the intercom routing interface transmits the indefinable data segments to each of the intercom panels 502 which is vital to thereby allow each of the intercom panels 502 to receive real-time and continuous information regarding the status of the emergency event. Use of the logic gate 601 ensures that a real-time emergency event is in progress and prevents the occurrence of a false alarm.

Referring to FIG. 1, the device further includes a central controller 10 mounted on an interior of a building structure. Such a central controller 10 includes a mechanism 611 which is necessary for transmitting the real-time emergency signals to each of the intercom panels during the emergency event. The real-time emergency signal transmitting mechanism 611 effectively includes: a processor 603 housed within the central controller 10, an intercom routing interface 101 electrically coupled to the processor 603 and positioned exterior of the central controller 10, a memory 604 electrically coupled to the processor 603 and including software instructions that cause the central controller 10 to transmit the real-time emergency signals directly to the intercom panels 502.

Such software instructions include and execute a programmable control logic algorithm which is important to determine an originating location of the real-time emergency signals and to determine a type of the emergency event by extracting selected data streams from the real-time emergency signals and passing the data streams into identifiable data segments. If the identifiable data segments have originated from a unique location and indicate a unique type of emergency event, then such a control logic algorithm is essential to generate first and second true control signals. If either one of the identifiable data segments did not originate from a unique location or did not indicate a unique type of emergency event, then the control logic algorithm effectively generates at least one false control signal. Use of the control logic algorithm provides a means of ensuring that a true emergency situation exists by testing for both a unique location and type of emergency event.

Referring to FIGS. 1 and 2, the system further includes a mechanism 612 for simultaneously transmitting the real-time emergency signals to the central monitoring station 605 which is critical to thereby allow the central monitoring station 605 to verify the emergency event directly with the intercom panels 502 and a user interface 101 electrically mated directly to the processor 603. Such a user interface 101 transmits a command signal which is crucial to the processor 603 based upon a user input and ensures that all intercom panels 502 in the building alert inhabitants of the real-time emergency event.

Referring to FIGS. 1 and 2, the real-time emergency signal simultaneous transmitting mechanism 612 effectively includes a plurality of communication interface networks 22, 26 electrically mated directly to the processor 603. Each of the communication interface networks 22, 26 receives the real-time emergency signals and a first communications link 606 is established between the communication interface networks 22, 26 and the central monitoring station 605 which is vital for transmitting the real-time emergency signals to the central monitoring station 605 such that the central monitoring station 605 receives continuous information regarding the emergency event. A second communications link 607 is conveniently established between the intercom routing interface 101 and the central monitoring station 605 such that the central-monitoring station 605 maintains direct communication with each of the intercom panels 502 during the emergency event.

Referring to FIG. 1, the system further includes a transducer 20 electrically mated directly to the processor 603 which is necessary for transmitting at least one of an audible and visual signal based upon the type of the detected emergency event. The programmable control logic algorithm provides the unexpected benefit of determining the originating location of a real-time emergency signal and identifying the type of emergency event. If the real-time emergency signal indicates the origination of a unique emergency event in a unique location, the control logic algorithm will generate first and second control signals, thereby transmitting the emergency signals to the central monitoring system 605 which in turn maintains direct communication with each of the intercom panels. Such benefits overcome the prior art shortcomings of limiting the transmission of the alarm signal to only a central monitoring station without transmitting the alarm signal to a plurality of intercoms throughout the house so that all persons within the building structure will be notified of the alarm. For example, building structures that have large square footages or loud music (such as an office or bar) can benefit from the present invention by transmitting the alarm signal through the entire structure via intercom panels located in the basement, break room, restrooms, warehouse, etc.

Referring to FIGS. 1-4, in a non-limiting exemplary embodiment, an interactive panoramic camera communication system 75 is operatively responsive to the real-time emergency signals. Such an interactive panoramic camera communication system 75 preferably includes a plurality of panoramic cameras 70 located within the building structure, an interactive camera service provider communications network 71, and a plurality of authorized peripheral electronic devices (APEDs) 72 located exterior of the building structure. The interactive camera service provider communications network 71 independently and communicatively couples each of the panoramic cameras 70 in real-time to each of the APEDs 72 such that the emergency event is independently transmitted and directly viewed in real-time at the APEDs 72. In this manner, the interactive camera service provider communications network 71 is independently operable from the real-time emergency signal transmitting mechanism 611 and the real-time emergency signal simultaneous transmitting mechanism 612, respectively. Notably, the emergency event is independently viewed at the APEDs 72 while the real-time emergency signals are transmitted to the central monitoring station 605 such that the APEDs 72 independently and visually learn the emergency event at least as early as the central monitoring station 605 non-visually learns the emergency event.

In a non-limiting exemplary embodiment, the interactive panoramic camera communication system 75 is operatively responsive to the real-time emergency signals. Such an interactive panoramic camera communication system 75 includes a plurality of panoramic cameras 70 located within the building structure, an interactive camera service provider communications network 71, and a plurality of authorized peripheral electronic devices (APEDs) 72 located exterior of the building structure. In this manner, the interactive camera service provider communications network 71 independently and communicatively couples each of the panoramic cameras 70 in real-time to each of the APEDs 72 such that the emergency event is independently transmitted and directly viewed in real-time at the APEDs 72. Notably, the interactive camera service provider communications network 75 is independently operable from the real-time emergency signal transmitting mechanism 611 and the real-time emergency signal simultaneous transmitting mechanism 612, respectively. Thus, the emergency event is independently viewed at the APEDs 72 while the real-time emergency signals are transmitted to the central monitoring station 605 such that the APEDs 72 independently and visually learn the emergency event at least as early as the central monitoring station 605 non-visually learns the emergency event.

In a non-limiting exemplary embodiment, the panoramic cameras 70 are automatically activated upon learning that the real-time emergency signals have been transmitted by sensors 25, 30, 35, respectively.

In a non-limiting exemplary embodiment, the interactive panoramic camera communication system 75 includes a processor 73; and a memory 74 including software instructions that cause the interactive camera service provider communications network 71 to execute a control logic algorithm. Such a control logic algorithm includes the steps of: learning of the emergency event at the building structure; activating a first one of the cameras 70 at the building structure and thereby causing the first camera to capture and generate a first video signal of the emergency event; identifying first and second ones of the APEDs 72 to wirelessly receive the first video signal; and requesting first and second authorization signals from the first and second APEDs 72.

In a non-limiting exemplary embodiment, the control logic algorithm further includes the steps of: if the first authorization signal is initially received before the second authorization signal, transmitting the first video signal to the first APED 72 and granting primary control access to the first APED 72 such that the second APED 72 cannot control operation of the first camera 70; if the second authorization signal is initially received before the first authorization signal, transmitting the first video signal to the second APED 72 and granting primary control access to the second APED 72 such that the first APED 72 cannot control operation of the first camera 70; if the first and second authorization signals are simultaneously received, determining which one of the first and second APEDs 72 has a higher hierarchical status; and transmitting the first video signal to one of the first and second APEDs 72 having the higher hierarchical status and thereafter granting primary control access thereto.

In a non-limiting exemplary embodiment, the control logic algorithm further comprises the steps of: after a predetermined time period has lapsed from transmission of the first video signal, requesting permission from the one APED 72 having the higher hierarchical status whether the other one of the first and second APEDs 72 having a lower hierarchical status can receive the first video camera; if permission is granted by the higher hierarchical one of the first and second APEDs 72, transmitting the first video signal to the lower hierarchical one of the first and second APEDs 72; and if permission is not granted by the higher hierarchical one of the first and second APEDs 72, asking the lower hierarchical one of the first and second APEDs 72 whether it wishes to independently view a second video signal from a second camera located at the emergency event.

In a non-limiting exemplary embodiment, the interactive camera service provider communications network 71 learns the hierarchical status by executing the following protocol: a nested group hierarchy is formed for selected one(s) of the APEDs 72. Each group of APEDs 72 can be allowed/denied access to view and/or control panoramic cameras 70 (either explicitly for that group, or implicitly by one a parent of the group). An APED 72 can be part of one or more groups. Each group is assigned a clearance level code (e.g., alphanumeric code or the like). Each APED 72 within each group is ranked as a parent or child of the group. A parent APED 72 can make decisions for the entire group; a child APED 72 cannot. The clearance level codes and ranks are embedded in the instructions signals generated and sent by each APED 72 to the interactive camera service provider communications network 71. Once the clearance level code is learned, the interactive camera service provider communications network 71 will either allow/deny control of the panoramic cameras 70. Furthermore, each panoramic camera 70 may require a minimum clearance level code and/or rank for access thereto.

In use, a method of utilizing a dual intercom-camera-interface security system for notifying multiple persons of an emergency event includes the steps of: providing a plurality of sensors 25, 30 and 35 for detecting the emergency event within a building structure. Such sensors 25, 30 and 35 are positioned in unique portions of the building structure and transmit real-time emergency signals that correspond to a detected type of the emergency event.

The steps further include providing a plurality of remotely located intercom panels 502 positioned in alternate areas of the building structure and are in communication with the sensors 25, 30 and 35. The steps further include providing a remotely located central monitoring station 605 in communication with the intercom panels 502; providing a central controller 10 mounted on an interior of a building structure; transmitting the real-time emergency signals to each of the intercom panels 502 during the emergency event; and simultaneously transmitting the real-time emergency signals to the central monitoring station 605 to thereby allow the central monitoring station 605 to verify the emergency event directly with the intercom panels 502.

The steps further include: providing an interactive panoramic camera communication system 75 operatively responsive to the real-time emergency signals. Such an interactive panoramic camera communication system 75 includes a plurality of panoramic cameras 70 located within the building structure, an interactive camera service provider communications network 71, and a plurality of authorized peripheral electronic devices 72 (APEDs) located exterior of the building structure. Next, the interactive camera service provider communications network 71 independently and communicatively couples each of the panoramic cameras 70 in real-time to each of the APEDs 72 such that the emergency event is independently transmitted and directly viewed in real-time at the APEDs 72.

The steps further include: independently operating the interactive camera service provider communications network 71 from the real-time emergency signal transmitting mechanism 611 and the real-time emergency signal simultaneous transmitting mechanism 612, respectively; independently viewing the emergency event at the APEDs 72 while the real-time emergency signals are transmitted to the central monitoring station such that the APEDs 72 independently and visually learn the emergency event at least as early as the central monitoring station 605 non-visually learns the emergency event; and simultaneously transmitting the real-time emergency signals to multiple ones of the intercom panels 502 located within the building structure while simultaneously transmitting video signals to multiple ones of APEDs 72 located exterior of the building structure.

The steps further include providing a processor 603 housed within the central controller 10; electrically coupling an intercom routing interface 101 to the processor 603; electrically coupling a memory 604 to the processor 603 and including software instructions that cause the central controller 10 to transmit the real-time emergency signals directly to the intercom panels 502. Such software instructions, including and executing a programmable control logic algorithm, include the steps of determining an originating location of the real-time emergency signals; determining a type of the emergency event by extracting selected data streams from the real-time emergency signals and parsing the data streams into identifiable data segments; and if the identifiable data segments have originated from a unique location and indicate a unique type of emergency event, then generating first and second true control signals. If either one of the identifiable data segments has not originated from a unique location or does not indicate a unique type of emergency event, then the steps include generating at least one false control signal.

The steps further include providing a logic gate 601 for receiving the control signals. Such a logic gate 601 generates a true output signal if both of the first and second control signals are true. The steps further include connecting a plurality of switches 602 in parallel with each of the intercom panels 502 and the logic gate 601 and simultaneously closing each of the switches 602 upon receiving the true output signal from the logic gate 601 such that the intercom routing interface 101 transmits the indefinable data segments to each of the intercom panels 502 to thereby allow each of the intercom panels 502 to receive real-time and continuous information regarding the status of the emergency event.

The steps further include providing a plurality of communication interface networks 22, 26 electrically mated directly to the processor 603. Each of the communication interface networks 22, 26 receives the real-time emergency signals. The steps further include establishing a first communications link between the communication interface networks 22, 26 and the central monitoring station 605 for transmitting the real-time emergency signals to the central monitoring station 605 such that the central monitoring station 605 receives continuous information regarding the emergency event and establishing a second communications link between the intercom routing interface 101 and the central monitoring station 605 such that the central-monitoring station 605 maintains direct communication with each of the intercom panels 502 during the emergency event.

FIG. 1 illustrates an overview of an exemplary intercom-enabled security system, according to the invention. Many buildings such as homes and small businesses today are equipped with security systems to secure the buildings, e.g., by deterring burglaries and detecting fires or noxious fumes such as carbon monoxide. An exemplary intercom-enabled security system 10 includes a central controller 10 that communicates with a number of sensors via a wired or wireless path. For example, the central controller 11 may receive signals from motion sensors 25 that detect when a person enters a room. Signals received from fire sensors 30 indicate that a fire has been detected. Signals received from carbon monoxide sensors 35 indicate that a dangerous level of carbon monoxide has been detected.

Signals received from a user interface device (not shown but well understood by one skilled in the art), such as a keypad and display, a combined display and touch screen, and/or a voice interface, may arm and disarm the system. The user interface device may be the primary interface between the human user and the security system 100. The user interface device typically includes components that are analogous to the central controller 10, including a processor 603, memory 604 and power source (not shown but well understood by one skilled in the art). Additionally, the central controller 10 includes a transceiver 12 (transmitter and receiver). The central controller 10 is commonly provided as a wireless device to allow it to be permanently installed in the home without running wire, such as by affixing it to a wall or placing it on a table, for instance. The central controller 10 generally is a larger component that may be installed in an unobtrusive location in the home, such as a closet or basement. However, it is not necessary for the user interface device to be separate from the central controller 10, or to communicate by wireless signals with the central controller 10. For example, the user interface device may be integrated into the central controller 10.

Various other components may communicate with the central controller 10, such as a wireless key fob/panic button that is used to trip an alarm. The central controller 10 may also transmit signals to components of the security system 100. For example, signals may be transmitted to a transducer 20 to activate the transducer when an alarm condition is detected. Signals are advantageously sent to the intercom interface routing circuit 101 to display status information to the user, such as whether the system is armed or disarmed, whether a high carbon monoxide level has been detected, and, when the system is armed, whether an alarm has been tripped.

The central controller 10 may also have the ability to notify local emergency services and/or a remote monitoring station of an alarm condition via a telephone network interface 22. The telephone network interface 22, such as a modem, allows the central controller 10 to send and receive information via a telephone link. The functionality of the network interface 22 may be combined into a computer network interface 26, for example, which allows the central controller 10 to send and receive information via a computer network, such as the Internet. The computer network interface 26 may include an always-on interface, such as a DSL or cable modem, and a network interface card, for example. Or, a dial-up telephone connection may be used. Other communication paths such as long-range radio and a cellular telephone link may also be used. The network interface 22 and interface 26 are typically hardwired to the central controller 10 and activated by the user interface and processor 603.

To facilitate installation and avoid the need to install wiring in a home, wireless security system components may be employed. Some components only transmit or receive. For example, the motion sensors 25, fire sensors 30, and carbon monoxide sensors 35 typically only transmit back to the central controller 10 when they are tripped, while the transducer 20 only receives a signal from the central controller 10 when the central controller 10 detects an alarm condition based on a signal received from one of the sensors. The user interface may have both transmit and receive capabilities to communicate with the central controller 10. The wireless security system components may use radio frequency (RF) signals. The exemplary system may use signals at 345 MHz to provide a nominal indoor range of 200 feet and an outdoor range of up to one mile. Different manufacturers may use different proprietary schemes for communicating data. For example, different coding and modulation techniques may be used.

The central controller 10 includes a transceiver 12 for transmitting and receiving wireless signals. The central controller 10 includes a microprocessor that executes software, firmware, micro-code or the like to implement logic (as explained hereinabove) to control the security system 100. The central controller 10 may include a non-volatile memory 604 and other additional memory as required. A memory resource used for storing software or other instructions that are executed by the central controller 10 to achieve the functionality described herein may be considered a program storage device. A dedicated chip such as an ASIC may also be used. Generally, each wireless component of the security system must be "learned" by the central controller 10. In the learning process, data is stored in the non-volatile memory 604 that identifies the characteristics of each sensor, including the sensor type, serial number or other code or identifier, and what type of action to take based on signals received from each sensor. For example, the action may be to provide a status message to the user, store data for subsequent maintenance purposes, or trip an alarm. The power source provides power to the central controller 10 and typically includes a battery backup to AC power.

Advantageously an existing security system can be modified to communicate with one or more intercom stations located within a building structure, e.g., to display information regarding the detected alarm, such as alarm status information, audio and video data, and the like, and provide commands to the intercoms so that all persons residing in the building structure are notified of identical information as detected by the central controller 10. In one approach, existing communication components and transmitting and receiving protocols of the central controller 10 and/or user interface device can be used. The appropriate control logic can be implemented as the central controller 10 and/or user interface device are upgraded. Communication interfaces can be added as needed, such as interfaces 22, 26 and 101, if they are not already present.

The functionality provided by the invention has many advantages. For example, the user has the ability to notify other persons in the building structure that an alarm event has been triggered from another location within the building structure, such as in the garage, kitchen, patio, etc., regardless of whether other persons are located in an up stairs bedroom, bathroom, basement, etc. In one possible approach, a user interface of the user's local security system, which may be at the user's home, for instance, is used to notify intercom systems at another location, such as a second home, e.g., a rental or vacation home, or the user's business location, such as a retail shop, office, warehouse or factory. Information is made available to the user regarding the second location, via a push approach, including intercom status information that indicates, e.g., whether an intercom is operating, when the intercom was turned on, whether the alarm is an intrusion alarm, fire alarm, noxious gas alarm, or other type, and other information such as an alert that the system has a malfunction or requires maintenance.

Further detailed information regarding an alarm may also be accessed. For instance, for an intrusion alarm, the user may be provided information regarding the source of the alarm, such as which zone in a building has triggered the alarm, the type of sensor that has been tripped (carbon monoxide, motion, etc.), or whether a panic button has triggered an alarm. The user can send commands to the various intercoms to control the system, e.g., to arm or disarm the system, set a bypass mode, and so forth. The bypass mode may be used to disable a sensor or zone in the secured building location that is triggering false alarms, for instance.

In one example, a user arms the alarm system in the user's home and goes to sleep. A high level of carbon monoxide is detected in one of the bedrooms. A child is also sleeping in the basement and a mother is sleeping in an upstairs bedroom. A local alarm is set at the home, e.g., by activating a local transducer, and, optionally, notifying a remotely located central monitoring station 605 via the telephone network interface 22. The local alarm signal is transmitted to the intercom interface circuit 101 and subsequently routed to all the intercoms 502 located in each of the rooms of the house, including the basement and the upstairs bedroom. In response to learning of the alarm, the user may take an action such as telephoning a caregiver at the home to inquire as to whether the alarm is a false alarm, for instance. If the alarm is a false alarm, the user can disarm the security system, such as by entering a key press sequence at the central controller 10 or intercom panels 502, causing a command to be sent to the security system at the home for disarming the security system.

Advantageously, the user need not travel back to the location of the detected carbon monoxide level to disarm the system, and need not disclose the code for disarming the system to others. Furthermore, the alarm message or other information such as maintenance messages, can be stored in memory at the user' home security system for later retrieval, e.g., if the user is not present in the home. An additional action may be automatically taken by the user's home security system as well, such as paging the user or sending a message to the user by cell phone or telephone, if the user does not acknowledge the alarm message, such as by entering a key press sequence on the user interface.

Advantageously, by communicating information via the existing security system components, there is no, or minimal, need for additional equipment in the secured location. Disruption to the home due to installing additional components and wires, for example, is minimal or nonexistent. Features of the existing security system, such a backup power and central station monitoring, are maintained and leveraged with a security system according to the invention.

FIGS. 1 and 2 illustrate a security system communicating with multiple intercom panels located through a building structure, according to the invention. A building is secured by the security system 100, and is in direct communication with a plurality of remotely located intercom panels 502 located through different rooms of the building. The different rooms may be separate structures, such as individual homes or business facilities. Or, the building locations may be different parts of a common structure, such as different apartments in an apartment building, or the lower and upper levels of a house, for instance. Note that the concept can be extended to more than a single security systems and building. Moreover, communication between the security system 100 and the intercom panels 502 needed not be bi-directional. Thus, the invention encompasses a scenario where the security system

100 transmits information such as alarm messages to the intercom panels 502, which do not have the ability to transmit data such as commands to the security system. Furthermore, in this case, the intercom panels 502 need not transmit alarm messages or other information to the security system 100. However, bi-directional communications where the security system 100 and the intercom panels 502 have similar transmit and receive capabilities, are also encompassed.

Communication between the security systems 100 and intercom panels 502 can be achieved in different ways. If the building is located sufficiently close to the central controller 10, communication may be achieved using a direct RF wireless path or RF pipeline. For instance, the existing transceiver 12 of a security system 100 may be used. Such a transceiver may be in place to transmit signals to the processor 603, which in turn sends control signals to the intercom interface circuit or other wireless components, such as a wireless transducer 20, as discussed previously. If the range of the existing transmitter in the transceiver 12 is not sufficient, a separate higher-powered transmitter may be used. Such a transmitter with its antenna can be located advantageously about the building, such as in an attic or on a rooftop, to ensure the desired range. An upgraded receiver and antenna at the receiving location may similarly be used. RF signaling has the advantage that a telephone line or computer network connection is not used. These communication paths thus remain free to report an alarm to a monitoring station as well as the intercom panels or allow a person to speak on the phone or access a computer network, for instance.

In another approach, the security system 100 uses a telephone link, such as a conventional telephone network interface 22, to communicate with one another. In this case, signaling using a compatible modem may be used. Any known communication technique may be used. This approach has the advantage that a computer network or RF channel is not used.

In another approach, the security system 100 uses a computer network interface 26 such as the Internet to communicate. For instance, the security system 100 may use a communications protocol such as TCP/IP to communicate with one another via the computer network interface 26. This approach has the advantage that a telephone link or RF channel is not used.

Note that a monitoring station 605 may be used to communicate with the security system 100 as well. For instance, alarm messages can be reported to the monitoring station, e.g., via the telephone interface 22 or the computer network interface 26. The monitoring station 605 may also transmit data to the security system 100 and intercom panels 502, such as software that is downloaded by the security system 100, to realize new features. Moreover, the monitoring station 605 may relay data between security systems. For instance, if the security system 100 is not able to transmit data directly to the intercom panels 502, e.g., due to a malfunction at the intercom interface circuit 101 or other problem, the security system 100 may instead, or additionally, transmit the data to the monitoring station 605. The monitoring station 605 can then periodically attempt to contact the intercom panels 502 to provide the data. This frees the security system 100 from repeatedly attempting to contact the intercom panels 502. The communication path used by the security system 100 therefore is available for other uses.

It is also possible for a security system to use different communication paths for upstream and downstream communications, or to use multiple paths of the same or different type for redundancy. For example, the security system 100 may transmit data to the intercom panels via the intercom interface circuit 101 and telephone network interface 22, while receiving data from the intercom panels 502 via the computer network interface 26. Or, the different communication paths may be attempted serially until a successful communication is made. To this end, the transmitting security system 100 may wait until it receives a confirmation from the intercom panels 502 that a transmitted message has been successfully received. If no confirmation is received, a next communication channel is tried.

As mentioned, the user interface device can be provided, e.g., as a peripheral to, or a part of, the main central controller 10. The exact arrangement of components is transparent to the user. Thus, the functionality that is described herein as being provided by a user interface device may be provided wholly locally to the device, or partially remotely, such as at the associated central controller 10. The user interface device includes a user input component such as a keypad and/or microphone for speech recognition in a voice-activated system, and a user output component such as a display and/or speaker. In one approach, a touch screen is used where the keypad or other icons are on a display. The display may be a multi-line, multi-character LCD display, for instance.

The display can provide a graphic device such as a cursor or other highlight to allow the user to select a particular function using a "select" key to obtain additional information or options. A separate display coupled via a link may be used to display video data from the remote security system. The speaker may play audio data from the remote security system. In the example shown, the display 0 indicates that an alarm has been set at a security system for a building location identified as "parent's house", and that the sensor that triggered the alarm is in the garage. The display may provide an image of the garage. The display further indicates that a security system is armed in a second building location identified as "local", e.g., the location in which the intercom panel 502 is provided.

Control logic associated with the central controller 10 allows it to control both the local security system 100 and the one or more remote intercom panels 502. Any appropriate menu display scheme and logic may be used. In particular, each intercom panel 502 may include a microprocessor that executes software, firmware, micro-code or the like stored in memory, or a dedicated chip such as an ASIC, to control the local and remote security systems. However, the intelligence can be carried out at different locations in the security system 100, such as at the central controller 10 and at one or more peripheral intercom panels 502.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A dual intercom-camera-interfaced security system for notifying multiple persons of an emergency event, said dual intercom-camera-interfaced security system comprising:

a plurality of sensors for detecting the emergency event within a building structure, said sensors being positioned in unique portions of the building structure and transmitting real-time emergency signals corresponding to a detected type of the emergency event;

a plurality of remotely located intercom panels positioned in alternate areas of the building structure and being in communication with said sensors;

a remotely located central monitoring station in communication with said intercom panels;

a central controller mounted on an interior of a building structure, said central controller including means for transmitting said real-time emergency signals to each of said intercom panels during the emergency event, and means for simultaneously transmitting said real-time emergency signals to said central monitoring station to thereby allow said central monitoring station to verify the emergency event directly with said intercom panels; and an interactive panoramic camera communication system being operatively responsive to said real-time emergency signals and including a plurality of panoramic cameras located within said building structure, an interactive camera service provider communications network, and a plurality of authorized peripheral electronic devices (APEDs) located exterior of said building structure;

wherein said interactive camera service provider communications network independently and communicatively couples each of said panoramic cameras in real-time to each of said APEDs such that the emergency event is independently transmitted and directly viewed in real-time at said APEDs;

wherein the emergency event is independently viewed at said APEDs while said real-time emergency signals are transmitted to said central monitoring station such that said APEDs independently and visually learn the emergency event at least as early as said central monitoring station non-visually learns the emergency event.

2. The dual intercom-camera-interfaced security system of claim 1, wherein said real-time emergency signal transmitting means comprises:

a processor housed within said central controller;

an intercom routing interface electrically coupled to said processor and positioned exterior of said central controller; and a memory electrically coupled to said processor and including software instructions that cause said central controller to transmit said real-time emergency signals directly to said intercom panels, said software instructions including and executing a programmable control logic algorithm including the step of determining an originating location of said real-time emergency signals, determining a type of the emergency event by extracting selected data streams from said real-time emergency signals and parsing said data streams into identifiable data segments, if said identifiable data segments have originated from a unique location and indicate a unique type of emergency event, then generating first and second true control signals, and if either one of said identifiable data segments has not originated from a unique location or does not indicate a unique type of emergency event, than generating at least one false control signal.

3. The dual intercom-camera-interfaced security system of claim 2, wherein said intercom routing interface comprises:

a logic gate for receiving said control signals, said logic gate generating a true output signal if both of said first and second control signals are true; and a plurality of switches connected in parallel with each of said intercom panels and said logic gate, said switches being simultaneously closed upon receiving said true output signal from said logic gate such that said intercom routing interface transmits said indefinable data segments to each of said intercom panels to thereby allow each of said intercom panels to receive real-time and continuous information regarding the status of the emergency event.

4. The dual intercom-camera-interfaced security system of claim 3, wherein said real-time emergency signal transmitting means comprises:

a plurality of communication interface modules electrically mated directly to said processor, each of said communication interface modules receiving said real-time emergency signals;

a first communications link established between said communication interface modules and said central monitoring station for transmitting said real-time emergency signals to said central monitoring such that said central monitoring station receives continuous information regarding the emergency event; and a second communications link established between said intercom routing interface and said central monitoring station such that said central-monitoring station maintains direct communication with each of said intercom panels during the emergency event.

5. The dual intercom-camera-interfaced security system of claim 2, further comprising: a transducer electrically mated directly to said processor for transmitting at least one of an audible and visual signal based upon the type of the detected emergency event.

6. The dual intercom-camera-interfaced security system of claim 1, wherein said panoramic cameras are automatically activated upon learning that said real-time emergency signals have been transmitted by said sensors, respectively.

7. The dual intercom-camera-interfaced security system of claim 6, wherein said interactive panoramic camera communication system comprising:

a processor; and a memory including software instructions that cause said interactive camera service provider communications network to execute a control logic algorithm comprises the steps of:

learning of the emergency event at the building structure;

activating a first one of said cameras at the building structure and thereby causing said first camera to capture and generate a first video signal of the emergency event;

identifying first and second ones of said APEDs to wirelessly receive said first video signal; and requesting first and second authorization signals from said first and second APEDs.

8. The dual intercom-camera-interfaced security system of claim 7, wherein said control logic algorithm further comprises the steps of:

if said first authorization signal is initially received before said second authorization signal, transmitting said first video signal to said first APED and granting primary control access to said first APED such that said second APED cannot control operation of said first camera;

if said second authorization signal is initially received before said first authorization signal, transmitting said first video signal to said second APED and granting primary control access to said second APED such that said first APED cannot control operation of said first camera;

if said first and second authorization signals are simultaneously received, determining which one of said first and second APEDs has a higher hierarchical status; and transmitting said first video signal to one of said first and second APEDs having said higher hierarchical status and thereafter granting primary control access thereto.

9. The dual intercom-camera-interfaced security system of claim 8, wherein said control logic algorithm further comprises the steps of:

after a predetermined time period has lapsed from transmission of said first video signal, requesting permission from said one APED having said higher hierarchical status whether said other one of said first and second APEDs having a lower hierarchical status can receive said first video camera;

if permission is granted by said higher hierarchical one of said first and second APEDs, transmitting said first video signal to said lower hierarchical one of said first and second APEDs; and if permission is not granted by said higher hierarchical one of said first and second APEDs, asking said lower hierarchical one of said first and second APEDs whether it wishes to independently view a second video signal from a second camera located at the emergency event.

10. An dual intercom-camera-interfaced security system for notifying multiple persons of an emergency event, said dual intercom-camera-interfaced security system comprising:

a plurality of sensors for detecting the emergency event within a building structure, said sensors being positioned in unique portions of the building structure and transmitting real-time emergency signals corresponding to a detected type of the emergency event;

a plurality of remotely located intercom panels positioned in alternate areas of the building structure and being in communication with said sensors;

a remotely located central monitoring station in communication with said intercom panels;

a central controller mounted on an interior of a building structure, said central controller including means for transmitting said real-time emergency signals to each of said intercom panels during the emergency event, and means for simultaneously transmitting said real-time emergency signals to said central monitoring station to thereby allow said central monitoring station to verify the emergency event directly with said intercom panels;

a user interface electrically mated directly to said processor, said user interface transmitting a command signal to said processor based upon a user input; and an interactive panoramic camera communication system being operatively responsive to said real-time emergency signals and including a plurality of panoramic cameras located within said building structure, an interactive camera service provider communications network, and a plurality of authorized peripheral electronic devices (APEDs) located exterior of said building structure;

wherein said interactive camera service provider communications network independently and communicatively couples each of said panoramic cameras in real-time to each of said APEDs such that the emergency event is independently transmitted and directly viewed in real-time at said APEDs;

wherein said interactive camera service provider communications network is independently operable from said real-time emergency signal transmitting means and said real-time emergency signal simultaneous transmitting means, respectively;

wherein the emergency event is independently viewed at said APEDs while said real-time emergency signals are transmitted to said central monitoring station such that said APEDs independently and visually learn the emergency event at least as early as said central monitoring station non-visually learns the emergency event.

11. The dual intercom-camera-interfaced security system of claim 10, wherein said real-time emergency signal transmitting means comprises:

a processor housed within said central controller;

an intercom routing interface electrically coupled to said processor and positioned exterior of said central controller; and a memory electrically coupled to said processor and including software instructions that cause said central controller to transmit said real-time emergency signals directly to said intercom panels, said software instructions including and executing a programmable control logic algorithm including the step of determining an originating location of said real-time emergency signals, determining a type of the emergency event by extracting selected data streams from said real-time emergency signals and parsing said data streams into identifiable data segments, if said identifiable data segments have originated from a unique location and indicate a unique type of emergency event, then generating first and second true control signals, and if either one of said identifiable data segments has not originated from a unique location or does not indicate a unique type of emergency event, than generating at least one false control signal.

12. The dual intercom-camera-interfaced security system of claim 11, wherein said intercom routing interface comprises:

a logic gate for receiving said control signals, said logic gate generating a true output signal if both of said first and second control signals are true; and a plurality of switches connected in parallel with each of said intercom panels and said logic gate, said switches being simultaneously closed upon receiving said true output signal from said logic gate such that said intercom routing interface transmits said indefinable data segments to each of said intercom panels to thereby allow each of said intercom panels to receive real-time and continuous information regarding the status of the emergency event.

13. The dual intercom-camera-interfaced security system of claim 12, wherein said real-time emergency signal transmitting means comprises:

a plurality of communication interface modules electrically mated directly to said processor, each of said communication interface modules receiving said real-time emergency signals;

a first communications link established between said communication interface modules and said central monitoring station for transmitting said real-time emergency signals to said central monitoring such that said central monitoring station receives continuous information regarding the emergency event; and a second communications link established between said intercom routing interface and said central monitoring station such that said central-monitoring station maintains direct communication with each of said intercom panels during the emergency event.

14. The dual intercom-camera-interfaced security system of claim 12, further comprising: a transducer electrically mated directly to said processor for transmitting at least one of an audible and visual signal based upon the type of the detected emergency event.

15. A method of utilizing a dual intercom-camera-interface security system for notifying multiple persons of an emergency event, said method comprising the steps of:

providing a plurality of sensors for detecting the emergency event within a building structure, said sensors being positioned in unique portions of the building structure and transmitting real-time emergency signals corresponding to a detected type of the emergency event;

providing a plurality of remotely located intercom panels positioned in alternate areas of the building structure and being in communication with said sensors;

providing a remotely located central monitoring station in communication with said intercom panels;

providing a central controller mounted on an interior of a building structure;

transmitting said real-time emergency signals to each of said intercom panels during the emergency event;

simultaneously transmitting said real-time emergency signals to said central monitoring station to thereby allow said central monitoring station to verify the emergency event directly with said intercom panels;

providing an interactive panoramic camera communication system operatively responsive to said real-time emergency signals, said interactive panoramic camera communication system including a plurality of panoramic cameras located within said building structure, an interactive camera service provider communications network, and a plurality of authorized peripheral electronic devices (APEDs) located exterior of said building structure;

said interactive camera service provider communications network independently and communicatively coupling each of said panoramic cameras in real-time to each of said APEDs such that the emergency event is independently transmitted and directly viewed in real-time at said APEDs;

independently operating said interactive camera service provider communications network from said real-time emergency signal transmitting means and said real-time emergency signal simultaneous transmitting means, respectively;

independently viewing the emergency event at said APEDs while said real-time emergency signals are transmitted to said central monitoring station such that said APEDs independently and visually learn the emergency event at least as early as said central monitoring station non-visually learns the emergency event; and simultaneously transmitting said real-time emergency signals to multiple ones of said intercom panels located within the building structure while simultaneously transmitting video signals to multiple ones of APEDs located exterior of the building structure.

16. The method of claim 15, comprises the steps of:

providing a processor housed within said central controller;

electrically coupling an intercom routing interface to said processor;

electrically coupling a memory to said processor and including software instructions that cause said central controller to transmit said real-time emergency signals directly to said intercom panels, said software instructions including and executing a programmable control logic algorithm including the step of determining an originating location of said real-time emergency signals, determining a type of the emergency event by extracting selected data streams from said real-time emergency signals and parsing said data streams into identifiable data segments, if said identifiable data segments have originated from a unique location and indicate a unique type of emergency event, then generating first and second true control signals, and if either one of said identifiable data segments has not originated from a unique location or does not indicate a unique type of emergency event, than generating at least one false control signal.

17. The method of claim 15, comprises the steps of:

providing a logic gate for receiving said control signals;

said logic gate generating a true output signal if both of said first and second control signals are true;

connecting a plurality of switches in parallel with each of said intercom panels and said logic gate; and simultaneously closing each of said switches upon receiving said true output signal from said logic gate such that said intercom routing interface transmits said indefinable data segments to each of said intercom panels to thereby allow each of said intercom panels to receive real-time and continuous information regarding the status of the emergency event.

18. The method of claim 15, further comprises the steps of:

providing a plurality of communication interface modules electrically mated directly to said processor, each of said communication interface modules receiving said real-time emergency signals;

establishing a first communications link between said communication interface modules and said central monitoring station for transmitting said real-time emergency signals to said central monitoring such that said central monitoring station receives continuous information regarding the emergency event; and establishing a second communications link between said intercom routing interface and said central monitoring station such that said central-monitoring station maintains direct communication with each of said intercom panels during the emergency event.

* * * * *